United States Patent [19]

Tsuda et al.

[11] 4,295,734

[45] Oct. 20, 1981

[54] FILTER ASSEMBLY FOR COLLECTING USED TONER OF ELECTROPHOTOGRAPHIC COPYING MACHINE

[75] Inventors: Hiroshi Tsuda, Mitaka; Kiyoshi Miyashita, Hachioji; Masaji Nishikawa, Hachioji; Akira Shimizu, Hachioji; Muneo Kasuga, Hachioji, all of Japan

[73] Assignee: Olympus Optical Company Ltd., Japan

[21] Appl. No.: 104,444

[22] Filed: Dec. 17, 1979

[30] Foreign Application Priority Data

Feb. 1, 1979 [JP] Japan ..... 54/10912

[51] Int. Cl.[3] ..... G03G 15/00

[52] U.S. Cl. ..... 355/15; 55/385 E; 55/481; 15/1.5 R

[58] Field of Search ..... 15/1.5 R; 55/385 E, 55/481; 210/236–238, 251, 470; 355/15

[56] References Cited

U.S. PATENT DOCUMENTS

| | | | |
|---|---|---|---|
| 3,410,060 | 11/1968 | Reilly et al. | 55/481 |
| 3,685,485 | 8/1972 | Kutsuwada et al. | 355/15 |
| 3,909,864 | 10/1975 | Tanaka et al. | 355/15 |
| 3,932,910 | 1/1976 | Shimoda | 355/15 |
| 4,093,369 | 6/1978 | Hewitt | 355/15 |

*Primary Examiner*—Ivars C. Cintins

*Attorney, Agent, or Firm*—Ostrolenk, Faber, Gerb & Soffen

[57] ABSTRACT

A filter assembly for use in an electrophotographic copying machine to collect used toner which is swept off a member carrying an electrostatic latent image, by means of a rotating brush comprises a filter unit having a toner receiver and a filter holder which are integrally formed together. The filter holder carries a filter element or elements therein, and the toner receiver allows the toner which falls down in front of the filter element to form a pile thereon. The unit is detachably mounted on the copying machine. A labyrinth seal is formed between the unit and the machine when the unit is mounted in place.

11 Claims, 5 Drawing Figures

FILTER ASSEMBLY FOR COLLECTING USED TONER OF ELECTROPHOTOGRAPHIC COPYING MACHINE

BACKGROUND OF THE INVENTION

The invention relates to a filter assembly for collecting used toner in an electrophotographic copying machine, and more particularly, to such filter assembly which collects used toner which is swept off an electrostatic latent image carrying member by means of a brush. In an electrophotographic copying machine which employs powder toner as a developer, it is necessary to clean, by utilizing some convenient means, the surface of a member such as a photosensitive drum which carries an electrostatic latent image thereon, by eliminating any residue of used toner which remain attached thereto, after the transfer of a toner image into a record member such as copy paper or the like. At this end, a conventional copying machine includes a brush which is disposed for rotation while maintaining contact with the surface of the member to scrape or sweep any residual toner off the member, a suction fan for producing an airstream which conveys used toner removed by the brush, and a filter disposed in the path of the airstream for collecting the used toner.

The applicant has previously proposed an improved cleaning unit (see Japanese Laid-Open patent application No. 137,352/1979 or patent application No. 46,187/1978) in which the cross-sectional area of the airstream which conveys the toner is increased in the vicinity of the collecting filter to reduce the speed of the airstream to thereby enhance the toner collecting efficiency of the filter and in which the toner is forced to fall down in front of the filter with a toner receiver disposed upstream of the filter to collect the falling toner therein, thus enhancing the toner collecting efficiency and permitting a facilitated maintenance with a simplified construction.

However, the improved cleaning unit, though it exhibits a number of excellent effects over the prior art, experiences an inconvenience when replacing the toner collecting filter. Specifically, the separate provision of the toner collecting filter and the toner receiver requires a separate discharge of the toner which is collected within the toner receiver when the filter is to be replaced. In addition, toner which is deposited on the front surface of the filter or a pile of toner formed immediately in front of the filter may be left within the body of the copying machine, causing a possible contamination of the surrounding environment. These possibilities may give rise to a fatal damage to the electrophotographic copying machine. Another difficulty with this construction is caused by a positioning frame disposed along the inner periphery of a duct in which the filter is disposed. This may leave a clearance between the duct and the filter to provide a bypass path through which part of the toner may be withdrawn by the fan, thus possibly marring a copy sheet.

SUMMARY OF THE INVENTION

It is an object of the invention to provide a filter assembly for collecting used toner of an electrophotographic copying machine which avoids the possibility of contaminating the interior and exterior of the machine and which permits a complete discharge of collected, used toner to the exterior when replacing a filter.

In accordance with the invention, the filter assembly comprises a filter unit including a toner receiver and a filter holder both of which are integrally connected together. The toner receiver is disposed upstream of the filter. The unit is detachably and interchangeably disposed within the body of the copying machine. Hence, when the filter is replaced, the toner receiver is simultaneously removed outside. In this manner, toner which is trapped within or collected on the front surface of the filter as well as a pile of toner which is formed in the toner receiver as a result of falling down by abutment against the front surface of the filter can be simultaneously discharged out of the machine. There is no residue of collected, used toner which is left within the machine, nor any scattering thereof. Since a perfect discharge is achieved, a contamination of both the inside and outside of the machine is effectively prevented.

In accordance with another aspect of the invention, a labyrinth seal is formed between the casing of the filter unit and the machine when the former is disposed in the latter. The labyrinth seal produces a pressure drop across any clearance formed between the casing and the body of the machine, thus providing a satisfactory sealing effect. This prevents any bypass flow path for the toner from being formed by the clearance between the filter and the body of the machine, again eliminating any likelihood that a scattering of used toner may cause the contamination of the machine.

In accordance with the invention, the labyrinth seal is formed by members including a lug which projects from the body of the copying machine to extend toward the filter unit, and a flute formed in the outer surface of the filter unit in alignment with the lug. These members also serve as guides for receiving the filter unit in the copying machine. A fool-proof loading is assured by locating these members asymmetrically, or offset from the center position lengthwise of the unit. In this manner, the possibility that the unit may be loaded in a wrong orientation which may cause a reduced toner collecting efficiency by disposing the toner receiver downstream of the filter is avoided. Thus, any difficulty which might otherwise occur with a filter unit having a integrally formed toner receiver and filter is effectively avoided.

It will be seen that in addition to overcoming the disadvantages of the described cleaning unit, a filter assembly is provided for collecting used toner which includes a number of additional effects.

DESCRIPTION OF PREFERRED EMBODIMENTS

Figure 1:
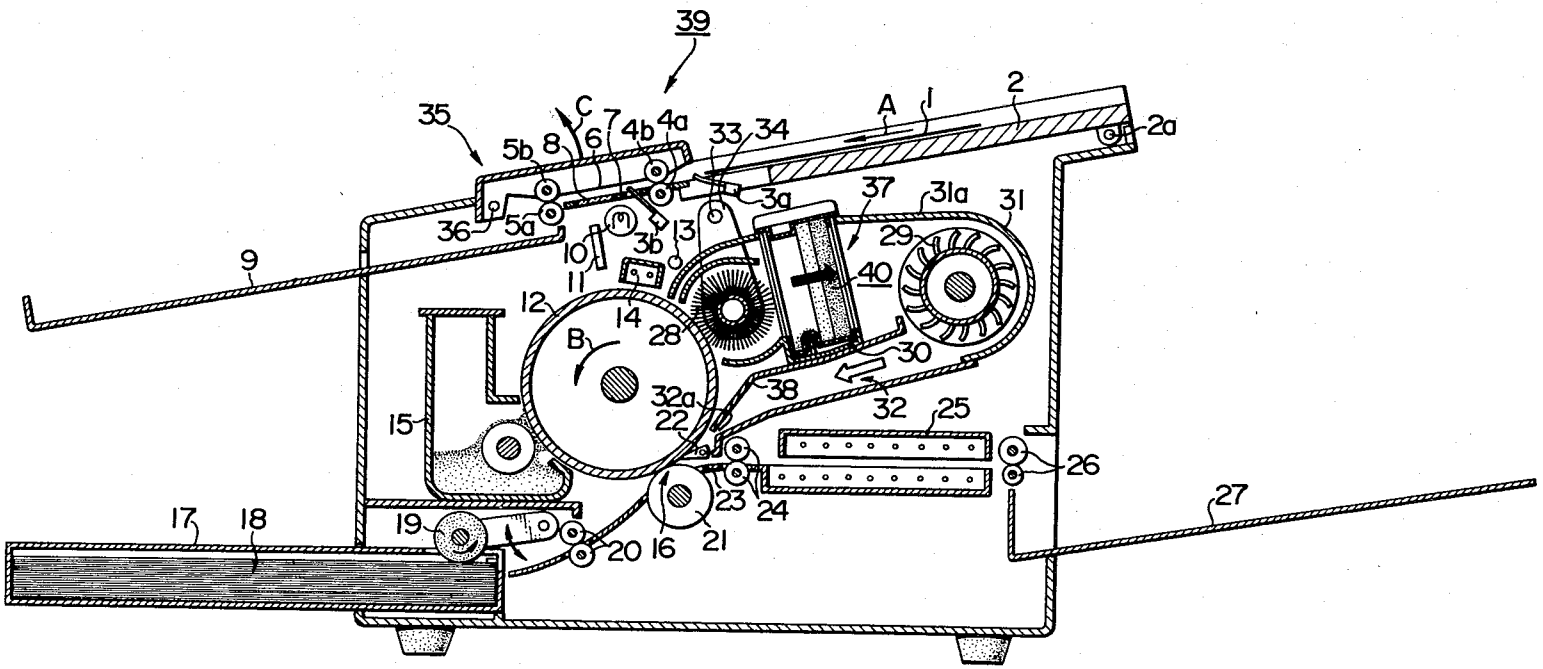
FIG. 1 is a vertical cross section of an electrophotographic copying machine in which a filter assembly for collecting used toner, constructed in accordance with the invention, is incorporated.

Referring to FIG. 1, there is shown an electrophotographic copying machine in which the filter assembly for collecting used toner according to the invention is incorporated. The machine is shown with an original passageway which is ready to receive a sheet of original material for copying it. Specifically, a sheet of original 1 is placed on an original receptacle 2 and is fed in a direction indicated by an arrow A into the inlet of an original conveyor unit 35 which comprises conveyor rollers 4*a*, 4*b*, 5*a*, 5*b* and guide plates 6, 7. Thereupon, the original 1 is held between a pair of vertically spaced conveyor rollers 4*a*, 4*b* and is fed toward an exposure station 8 while passing between the guide plates 6, 7. As the original 1 moves past the exposure station 8, it is held between another pair of vertically spaced conveyor rollers 5*a*, 5*b* to be delivered into an original tray 9.

When the original 1 is being conveyed by the unit 39, a pair of microswitches 3*a*, 3*b* which are disposed on the opposite sides of the conveyor roller 4*a* detect the position of the original 1 to provide an output which is utilized to control the timing of the operation of the various parts of the copying machine. As the original 1 moves past the exposure station 8, an illumination lamp 10 illuminates the surface of the original, whereby an optical system 11 projects an image of the original onto a latent image carrying member 12 in the form of a photosensitive drum. As shown, the member 12 rotates in the direction of an arrow B. At the outset, after being neutralized by a neutralizer lamp 13, the member 12 is uniformly charged by a corona charger 14, and is then exposed to the optical image of the original to have an electrostatic latent image of the original 1 formed on its surface. The latent image is developed into a toner image by a developing unit 15 of the dry type. Subsequently, the toner image is carried to a toner image transfer station 16 as the member 12 further rotates.

On the other hand, a cassette 17 contains a supply of record papers 18, which are fed one by one by a feed roller 19 which is adapted to oscillate and rotate, and thence into the transfer station 16 at a given timing, by means of a pair of vertically spaced feed rollers 20. In the transfer station 16, the record paper is moved into superimposition with the toner image formed on the member 12 against which it is urged by a transfer roller 21. A bias voltage is applied across the member 12 and the transfer roller 21 to effect a transfer of the toner image. Since the record paper is conveyed in close contact with the member 12 during such process, it is subsequently separated from the member by means of a separating claw 22 and an airstream which will be described later. After having the toner image transferred thereto, the record paper is then conveyed along a guide 23 and is driven by a pair of vertically spaced conveyor rollers 24 into a heated fixing unit 25 which is provided with a heater. The toner image is melted and fixed in the unit 25, and thereafter delivered into a copy tray 27 by means of a pair of vertically spaced delivery rollers 26.

In the meantime, any residue of used toner which remains on the member 12 without being transferred onto the record paper, though small in quantity, is swept off by a rotating cleaning brush 28, and is then withdrawn by a conveying airstream produced by a suction fan 29 to be collected by a filter assembly 40 according to the invention. In order to increase the cleaning effect upon the remaining toner, the cleaning brush 28 and the fan 29 are enclosed by covering 31 which prevents a scattering of used toner within the machine. The covering 31 includes a top panel 31*a*, which together with support plates 30, 38 disposed inside the covering in the lower region thereof, defines a suction duct 37. The airstream discharged by the fan 29 is introduced into an air supply duct 32 which has its discharge port 32*a* positioned adjacent to the transfer station 16, thereby effectively separating the record paper from the member 12 by cooperation with the claw 22.

It is to be noted that the electrophotographic copying machine shown is adapted to provide a plurality of copies in succession by repeatedly utilizing an electrostatic latent image once formed on the member 12 and by repeating the steps of developing it with the toner and transferring the toner image onto the record paper. In this instance, the cleaning brush 28 is moved away from the member 12 by turning a brush holder 34 which is pivotally mounted at 33 and on which the brush 28 is mounted. Simultaneously, the neutralizer lamp 12 and the charger 14 are held inoperative since in this instance the latent image on the member 12 must not be cleaned each time the image is transferred onto a copy sheet.

In the cleaning unit which comprises the cleaning brush 28, the filter assembly 40 and the suction fan 29, the assembly 40 includes a pair of coarse and fine mesh filter elements, and the cross-sectional area of the flow path for the toner conveying airstream in a region upstream of the filter assembly is gradually increased toward the downstream side thereof to thereby decrease the speed of the airstream, thus facilitating the toner to be collected by the filter and allowing toner particles of greater diameters to fall down in front of the filter. The filter assembly 40 has a unitary construction which can be removed, by moving it upwardly through the top of the copying machine. When it is to be removed, the original receptacle 2 is rocked clockwise about a pivot 2*a*, thus opening the top of the machine.

Figure 2:
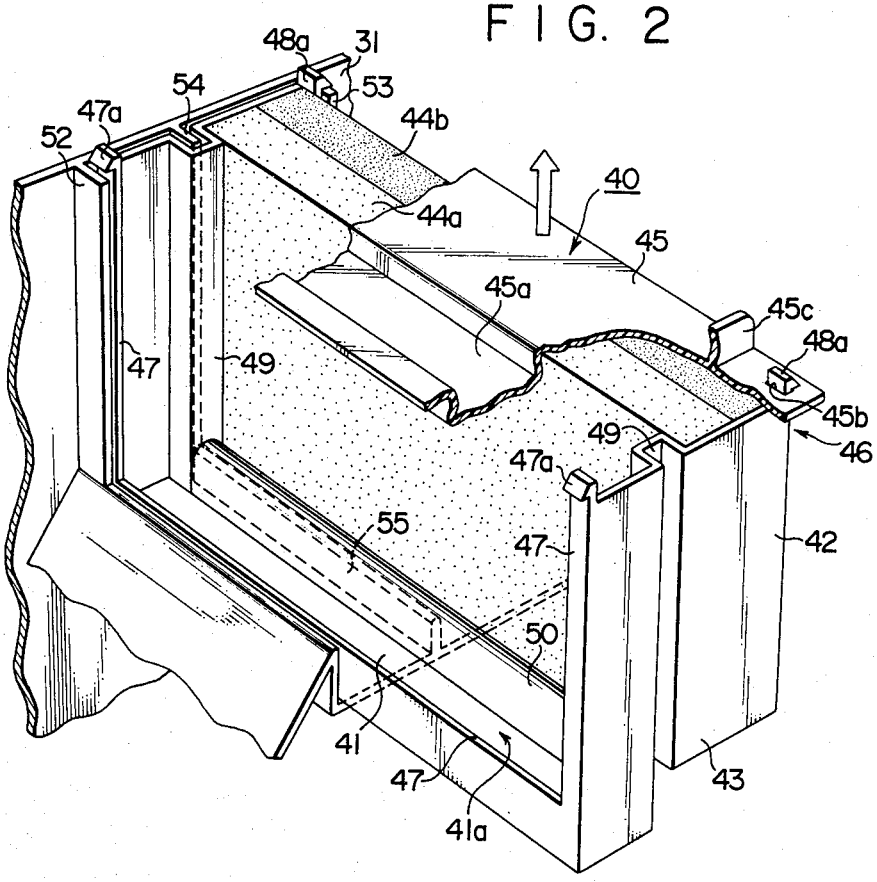
FIG. 2 is a perspective view of the filter assembly.
Figure 3:
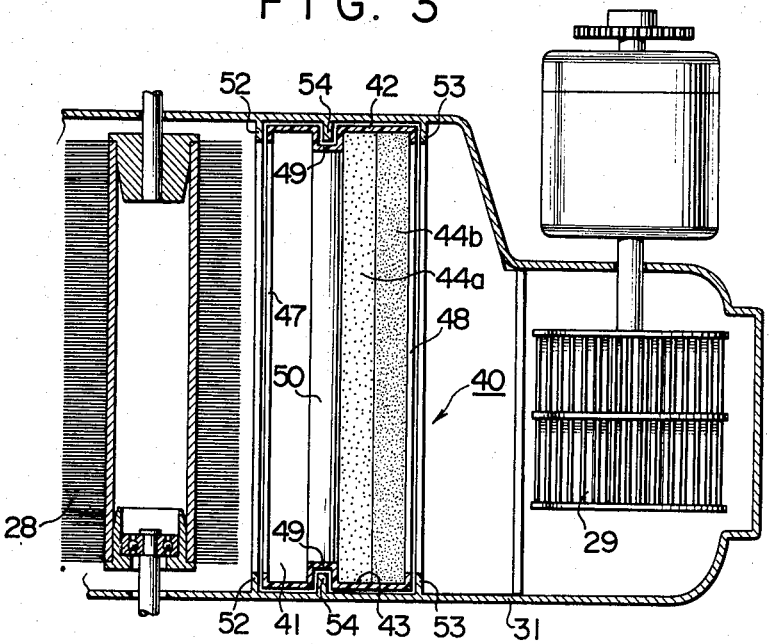
FIG. 3 is a transverse cross section of the filter assembly.
Figure 4:
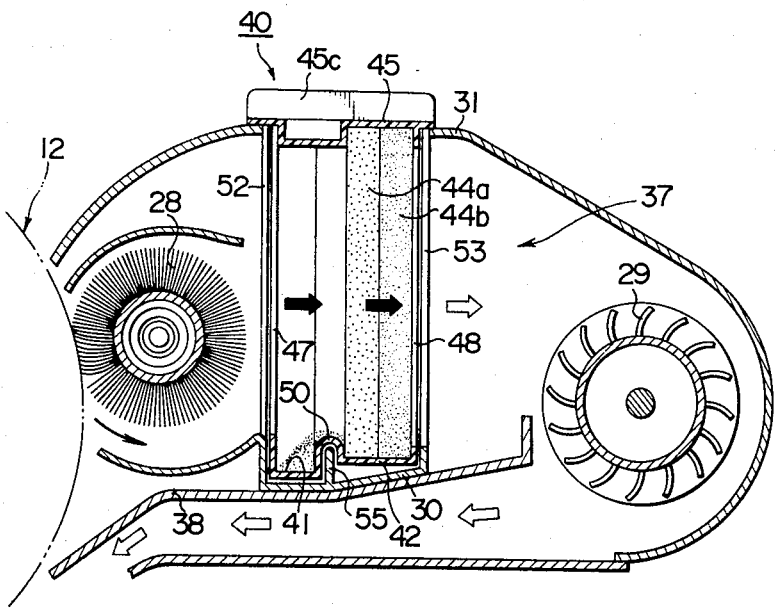
FIG. 4 is a longitudinal section of the filter assembly.

Referring to FIGS. 2 to 4, the filter assembly 40 is formed by a filter unit 46 which comprises a frame-shaped casing 43 which is open at its upstream and downstream ends as well as at its top and which is integrally formed with a toner receiver 41 adjacent to its front end and with a filter holder 42 adjacent to its rear end; a pair of coarse and fine mesh filter elements 44*a*, 44*b* which are detachably received within the filter holder 42; and a coverplate 45 mounted on the top of the casing 43.

The casing 43 is molded from a plastic material into a rectangular box-configuration, and the both lateral walls and the bottom wall of the casing are formed with positioning ledges at the front and rear ends of the casing which extend inwardly. The upper ends of these ledges 47, 48 are formed with detent pawls 47*a*, 48*a* for firmly securing the coverplate 45 thereon. Toward their front end, the both lateral sidewalls of the casing 43 are formed with vertically extending flutes 49 which are channel-shaped in cross section and which project into the casing 43. The bottom wall of the casing 43 is formed with a horizontally extending flute 50 which communicates with the flutes 49 and which has an inverted U-shape cross-sectional configuration projecting into the casing 43. When the filter unit 46 is disposed in the body of the copying machine, these flutes 49, 50 serve to form labyrinth seals by fitting engagement with lugs formed on the machine which will be described later. The vertically extending flutes 49 also serve as guides for receiving the unit 46.

Toner receiver 41 is located forwardly of the flutes 49, 50, and includes a bottom surface 41*a* which is disposed below the lower edge of the filter elements 44*a*, 44*b* which are to be received within the filter holder 42 in order to prevent an adverse influence of any pile of toner formed on the toner receiver upon the functioning of the filter elements 44*a*, 44*b*.

As a result of the toner receiver 41 which is formed integrally with the casing 43, any pile of toner which is formed within the toner receiver 41 can be simultaneously discharged as the filter is replaced. If the toner receiver were formed separately from the filter casing, it would be necessary to remove the toner receiver separately from a changing operation of the filter. In addition, a pile of toner formed in the duct and which is in contact with the front surface of the filter may be left within the duct when the filter is replaced. Since the pile will be formed to be higher in elevation as the filter is approached, it tends to collapse into the space previously occupied by the filter. This would prevent a complete discharge of toner to the exterior of the machine. The invention completely eliminates such difficulty.

As mentioned previously, detachably mounted in the filter holder 42 are the coarse mesh filter element 44*a* having a higher suction efficiency and the fine mesh filter element 44*b* having a lower suction efficiency. The coarse mesh filter element 44*a* is located nearer the toner receiver 41, and the fine mesh filter element 44*b* is disposed in abutment against the rear side of the filter element 44*a*.

The coverplate 45 is mounted on the top of the casing 43. It comprises a flat rectangular plate formed with a channel-shaped recess 45*a* in vertical alignment with the toner receiver 41. At its corners, the coverplate is formed with apertures 45*b* which are aligned with the location of the respective detent pawls 47*a*, 48*a*. Thus, after the filter elements 44*a*, 44*b* are inserted into the filter holder 42, the coverplate 45 can be connected integrally with the casing 43 by press fitting the apertures 45*b* over the pawls 47*a*, 48*a*. The coverplate 45 is provided with a pair of handles 45*c* at locations which are symmetrically spaced apart in the lateral direction, for the convenience of removing the unit.

It is to be noted that the recess 45*a* formed in the coverplate 45 is disposed in abutment against the front side of the filter element 44*a* to stabilize it.

The covering 31 (see FIG. 1) is formed with projections 52, 53 which bear against the outer side of the individual positioning ledges 47, 48, as well as lugs 54 which fit in the flutes 49. The support plate 30 disposed within the covering 31 is also formed with a projection 55 which fits in the flute 50.

As a result of the described construction, when the filter unit 46 is mounted in place along the positioning projections 52, 53 and the lugs 54, the filter elements 44*a*, 44*b* are disposed in the path of the toner conveying airstream, and the lugs 54, 55 form labyrinth seals together with the flutes 49, 50 in which they fit. In other words, a pressure drop is produced across any clearance formed between the lugs 54, 55 and the flutes 49, 50 which is sufficient to provide a seal between the upstream side and the downstream side of the filter assembly, thus leaving only the latter in the path of the toner being conveyed.

By contrast, in a conventional electrophotographic copying machine having a detachable and interchangeable filter, a clearance is unavoidably formed between the filter casing and a duct which is provided on the part of the machine, with consequence that the toner which passes through the clearance causes a marring of copy sheets. A gasket may be provided in the clearance to avoid such difficulty, but its provision degrades the ease of removing or attaching the filter. In addition, after repeated attachment and removal, the gasket is subject to a permanent deformation which causes it to fail to provide a sufficient sealing effect. Such disadvantage is completely eliminated in accordance with the invention by providing the labyrinth seals.

It should be understood that an effect similar to the labyrinth seals can be achieved by forming ledges on the casing 43 while providing flutes in the inner surface of the duct. However, in this instance, a difficulty is experienced in that any toner which has found its way into the flutes cannot be easily removed. When the lugs are provided on the part of the duct as shown in the embodiment, it is a simple matter to remove any toner which accumulated in the duct. Another difficulty results with this construction as a result of the fact that the casing of the filter unit is advantageously molded from a plastic material for a mass production of disposable type. In this instance, the casing of the filter unit must be provided with projections, separately from the ledges which define the labyrinth seals, in order to hold the filter elements 44*a*, 44*b* in place, thus requiring a complex molding operation. By contrast, when the casing 43 is formed with the flutes 49, 50 as in the described embodiment, the resulting projection can be advantageously utilized to hold the filter elements 44*a*, 44*b* in place. Where the ledges are formed on the external surface of the casing of the filter unit, the external configuration of the casing will be an unstable one, and also increases its size, which is disadvantageous for packaging purposes. Such an inconvenience can be avoided in the embodiment where the flutes are formed in the casing.

Figure 5:
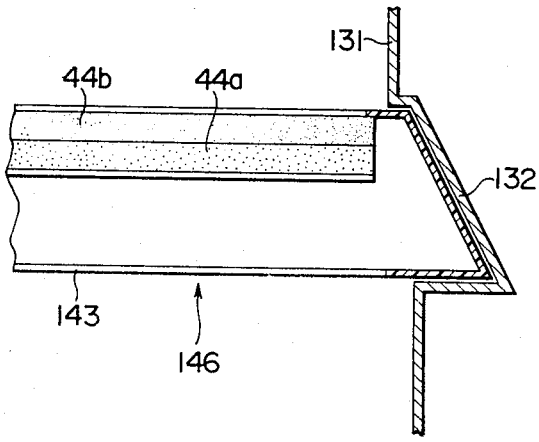
FIG. 5 is a fragmentary cross section of a filter assembly according to another embodiment of the invention.

As a result of the provision of the toner receiver 41 which is integral with the casing 43, there is a possibility that the toner receiver 41 may be disposed downstream of the filter elements 44*a*, 44*b* by a wrong loading if the filter unit 46 is constructed such that it can be loaded in a reversible manner or either end forward, as viewed in the direction of the flow of the conveying airstream. This would cause a premature plugging of the filter elements to reduce their useful life. In addition, the toner may directly accumulate on the duct 37. To avoid such a likelihood, the labyrinth seals are located at a position which is asymmetrical lengthwise of the casing 43 as illustrated in the embodiment of FIGS. 2 to 4. Alternatively, the casing 43 itself may be formed to present an asymmetrical configuration as viewed lengthwise thereof. By way of example, in an embodiment shown in FIG. 5 where a filter unit 146 is designed to be removed upwardly through the top of the machine, a casing 143 of the unit may be formed trapezoidal in horizontal cross section to fit in a corresponding trapezoidal portion 132 of a duct 131, thus preventing a loading of the filter unit in a wrong orientation. Again, a sufficient pressure drop can be produced across any clearance formed between the portion 132 and the casing 143 to provide a satisfactory sealing effect.

From the foregoing description, it will be appreciated that the invention enables a pile of toner which is formed in front of the filter elements to be discharged out of the machine at the same time as the filter is replaced, thus effectively preventing a contamination inside and outside of the machine. Although the invention is particularly useful with a filter unit of disposable type in which the casing is molded from a plastic material, it should be understood that the invention is not limited thereto, but is equally applicable to any filter unit of a type in which only the filter elements are changed.

In the described embodiment, the filter unit contains a pair of coarse and fine mesh filter elements, but it will be appreciated that any number of filter elements may be used.

What is claimed is:

1. In an electrophotographic copying machine including a brush which rotates while maintaining its contact with a member which carries an electrostatic latent image to remove any residue of unnecessary toner which remains attached to said member, a suction fan for producing an airstream which conveys the toner removed by said brush, and a filter assembly disposed in the path of the airstream for collecting used toner; the improvement comprising:

(a) a one piece filter cassette having a toner receiver compartment and a separate filter holder compartment formed therein, said filter holder compartment receiving a replaceable filter element therein, said toner receiver compartment being located upstream of said filter holder compartment in a position which permits toner which strikes said filter element and falls down in front of said filter element to form a pile therein; and (b) means for positioning said filter cassette in the path of the airstream formed within the copying machine, said filter cassette and positioning means cooperating in such a manner that said filter cassette can be slidably placed in and slidably removed from said positioning means, said positioning means including a labyrinth arrangement for forming a labyrinth seal between said filter cassette and said positioning means when said filter cassette is mounted in said positioning means such that said airstream passes through said cassette but does not pass between said cassette and said positioning means.

2. A machine according to claim 1 in which said filter cassette comprises a frame-shaped casing which is open at its upstream and downstream ends as well as at its top, said casing being formed with said toner receiver adjacent to its upstream end and formed with said filter holder adjacent to its downstream end, said filter element being received within said casing, and a coverplate adapted to be mounted on top of said casing.

3. A machine according to claim 2 in which said frame-shaped casing and said coverplate are formed of a plastic material, the upper end faces of said casing being provided with projecting detent pawls over which apertures formed in the coverplate are a press fit, thereby integrally securing said coverplate to said casing.

4. A machine according to claim 2 in which said coverplate is provided with a handle on its outer surface.

5. A machine according to claim 2 wherein said filter element includes a pair of coarse and fine mesh filter elements of a high and a low suction efficiency, respectively, said coarse mesh filter element being located upstream of said fine mesh filter element.

6. A machine according to claim 2 in which said frame-shaped casing is trapezoidal in horizontal cross section, with its bevelled surfaces mating with the copying machine.

7. A machine according to claim 1 in which said labyrinth arrangement comprises a flute formed in the outer surface of said filter cassette, and a lug formed on part of said copying machine, said lug being adapted to fit in said flute when said filter cassette is mounted in said positioning means.

8. A machine according to claim 7 in which the formation of the flute provides an internal projection on the inner surface of the filter cassette which divides said cassette into said filter holder and toner receiver compartments.

9. A machine according to claim 7, in which said filter cassette has a front ledge and a rear ledge and wherein said flute extends into said cassette, said rear ledge and said flute defining said filter holder compartment, said flute and said front ledge defining said toner receiver compartment.

10. A machine according to claim 1, further comprising means for preventing said filter cassette from being mounted with a wrong orientation.

11. A machine according to claim 10 in which said means for preventing the filter cassette from being mounted with a wrong orientation comprises said labyrinth arrangement which is disposed of at a location either forwardly or rearwardly offset from a lengthwise center of the filter cassette and wherein the labyrinth arrangement comprises a flute formed in the outer surface of said filter cassette and a lug formed on part of the copying machine and adapted to fit in the flute when said filter cassette is mounted in place.

* * * * *